United States Patent [19]

Buhk

[11] 3,947,068

[45] Mar. 30, 1976

[54] CHAIR

[75] Inventor: Randall P. Buhk, Wyoming, Mich.

[73] Assignee: Steelcase Inc., Grand Rapids, Mich.

[22] Filed: Apr. 22, 1974

[21] Appl. No.: 463,192

[52] U.S. Cl. ..... 297/445; 297/DIG. 2; 297/411; 297/458; 297/460

[51] Int. Cl.[2] ..... A47C 3/00

[58] Field of Search ..... 297/DIG. 2, 414, 416, 422, 297/440, 443, 445, 452, 418, 420, 422, 453, 460; 248/188, 188.1, 188.8; D6/73, 67, 68

[56] References Cited

UNITED STATES PATENTS

| | | | |
|---|---|---|---|
| 2,815,067 | 12/1957 | Richardson | 297/416 X |
| 2,824,602 | 2/1958 | Collins et al. | 297/DIG. 2 |
| 2,882,958 | 4/1959 | Monroe et al. | D6/73 X |
| 2,966,208 | 12/1960 | Good | 297/411 |
| 3,120,407 | 2/1964 | Probst | 297/457 |
| 3,173,723 | 3/1965 | Hoven et al. | 297/DIG. 2 |
| 3,182,377 | 5/1965 | Hoven et al. | 297/DIG. 2 |
| 3,285,555 | 11/1966 | Bevington | 248/188.7 |
| 3,310,343 | 3/1967 | Schultz | D6/73 X |
| 3,586,370 | 6/1971 | Barecki et al. | 297/219 |
| 3,734,561 | 5/1973 | Barecki et al. | 297/DIG. 2 |
| 3,768,864 | 10/1973 | Niewulis | 297/DIG. 1 |
| 3,788,701 | 1/1974 | Massaccesi | 297/455 |
| 3,807,800 | 4/1974 | Morrison | 297/219 X |
| 3,815,956 | 6/1974 | Bocksch | 297/418 |
| 3,826,533 | 7/1974 | Andrus | 297/DIG. 2 |
| D225,843 | 1/1973 | Buhk | D6/73 X |
| D232,136 | 7/1974 | Persson | D6/73 X |
| D233,964 | 12/1974 | Morrison et al. | D6/73 X |
| D235,235 | 6/1975 | Blodee | D6/67 |

*Primary Examiner*—James T. McCall
*Attorney, Agent, or Firm*—Price, Heneveld, Huizenga & Cooper

[57] ABSTRACT

The specification discloses a highly styled yet inexpensive chair in which a stretcher is mounted to a base, a pair of spaced side rails are mounted to the ends of the stretcher, and formed, plastic supporting seat and back are seated on the side rails. Upholstered formed plastic inner seat and inner back formed generally to the shape of the supporting seat and back respectively, are attached to the formed plastic supporting seat and supporting back. The stretcher includes struts having means for securing the ends of optional arms thereto whereby the chair can be provided either with or without arms.

17 Claims, 20 Drawing Figures

CHAIR

BACKGROUND OF THE INVENTION

The present invention relates to office furniture chairs, particularly those in the lower price category.

One type of lower priced office furniture chair is that comprised of a boxy framework of tubular elements including legs and cross pieces for supporting upholstered and cushioned seat and back boards. Arms can be provided by extending the front legs up to arm level and providing fore and aft cross pieces between the top of the front legs and the upwardly projecting back tubes. These chairs, by the nature of their construction, are of a simple, straightforward construction and are not highly styled in appearance.

Also, these chairs are too expensive for some purposes since it is expensive to upholster and cushion the seat boards. A type of less expensive chair which takes advantage of the attractive appearance and strength of plastic is the typical stacking chair. Plastic seat and back members are placed on some type of frame. Upholstering is not necessary due to the fact that plastic can be made fairly attractive. However, such stacking chairs are used primarily in institutional environments because they do not have a highly styled appearance.

A third type of chair which can be given a highly styled appearance is the sling chair in which upholstery is supported by slinging it between spaced side rails. This eliminates the cost of upholstering seat and back boards and makes it possible to provide a very highly styled design for the chair. One problem with such chairs, however, is that it is expensive to assemble the sling arrangement. Accordingly, sling chairs are typically more expensive than the basic box framework chair or the stacking chair referred to above.

SUMMARY OF THE INVENTION

The present invention comprises a chair of an inexpensive construction which is of such a nature that the chair can be given a highly styled appearance. A pair of spaced rails are joined to a centrally located spreader which is operably mounted on a base. Formed plastic supporting seat and back means are seated on the rails. Formed plastic inner seat and back means are provided having a shape conforming generally to the configuration of the front of the seat and back and upholstery means are provided to cover the front of the inner seat and back means. The upholstery is wrapped around the edges of the inner seat and back means. The thus covered inner seat and back means are then secured to the supporting seat and back means by suitable securing means. By providing a stylish configuration to the spaced side rails and by providing a curved, sculptured configuration to the plastic supporting seat and back and to the plastic inner seat and back, one can give this chair a very highly styled configuration. Yet, one can manufacture the chair very economically and can sell it in the lower priced chair market to which the popular box type frame chain is sold.

Another styling variation which is facilitated by the present invention is that optional arms can be provided. The stretcher includes a central base mounting area and spaced fore and aft channel struts projecting outwardly from each side thereof. The optional arms include end portions projecting inwardly and being received in the channels. Suitable attaching means are provided for attaching the end portions to the channel struts.

These and other objects, features and advantages of the present invention will be more fully understood and appreciated by reference to the written specification and appended drawings.

DESCRIPTION OF THE PREFERRED EMBODIMENT

Figure 1:
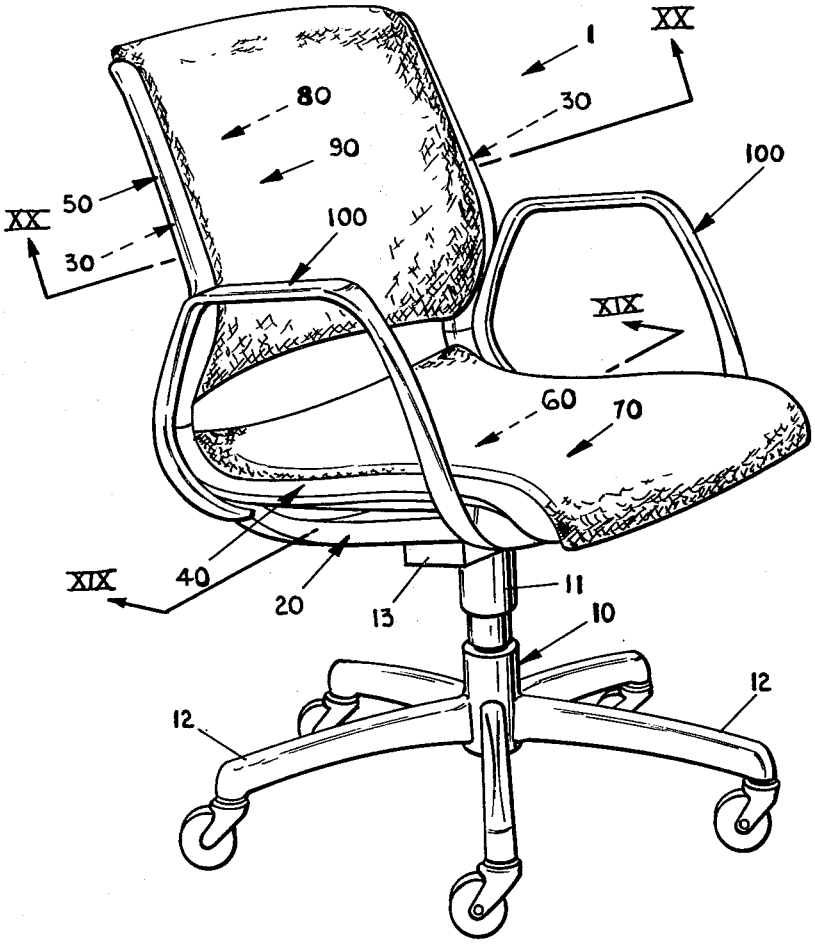
FIG. 1 is a perspective view of the chair of the present invention with the optional arms attached.
Figure 2:
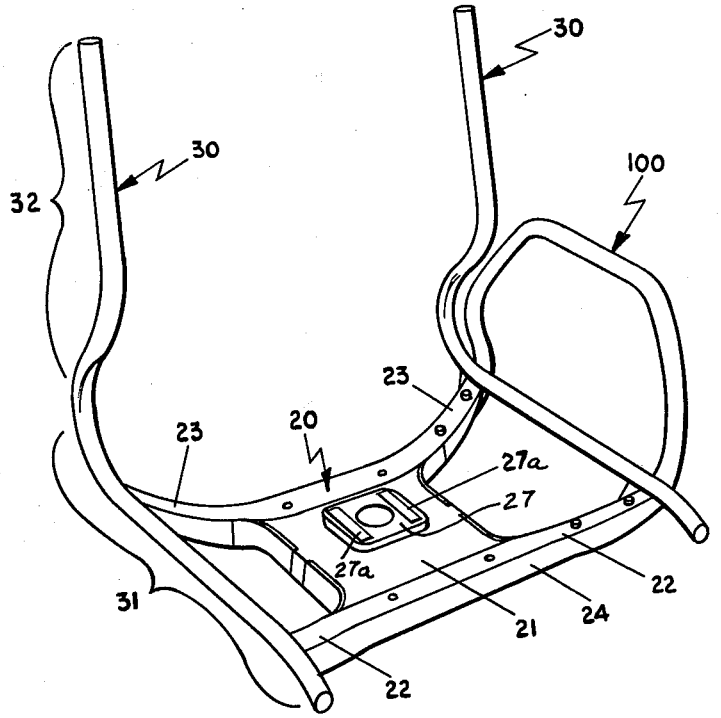
FIG. 2 is a perspective view of the stretcher and side rails of the chair with one arm attached.
Figure 3:
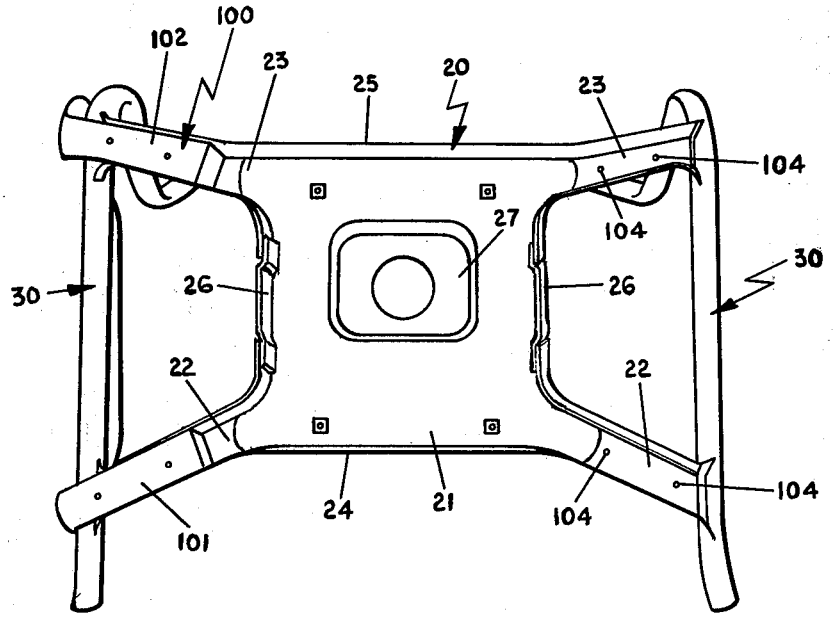
FIG. 3 is a bottom plan view of the stretcher and side rails with one arm attached.
Figure 15:
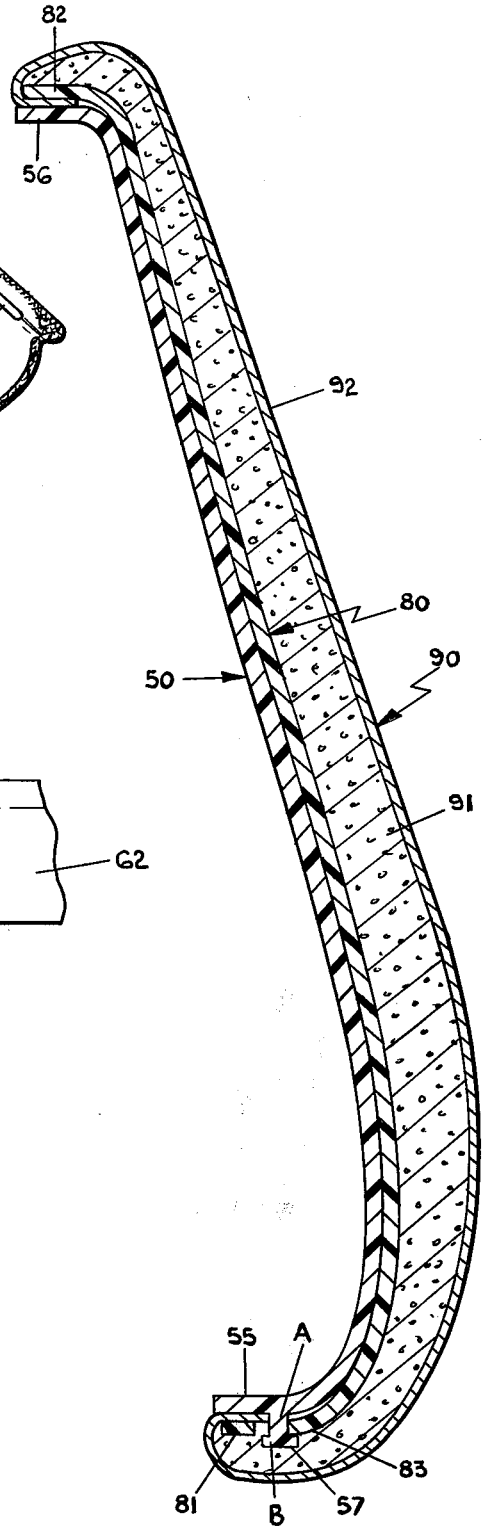
FIG. 15 is a cross-sectional view of the inner back with upholstery covering fitted over the back, taken generally along plane XV—XV of FIG. 4.
Figure 14:
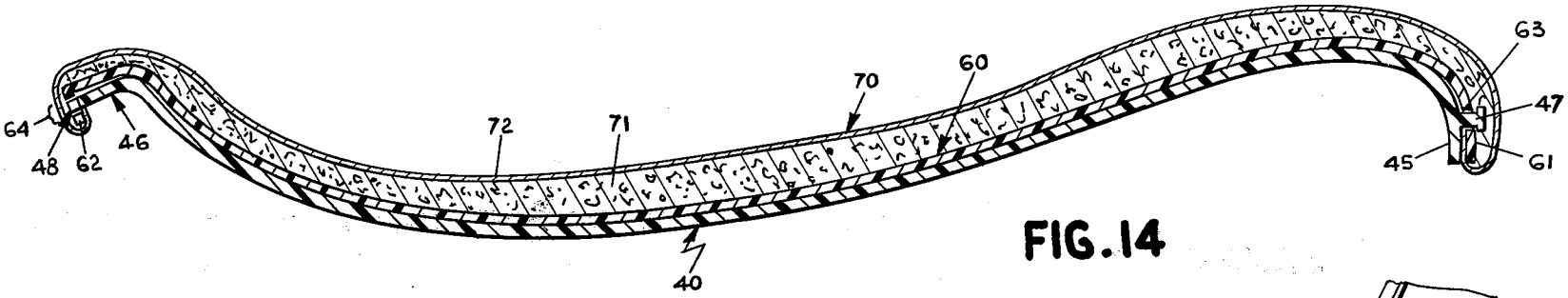
FIG. 14 is a cross-sectional view of the inner seat assembled on the supporting seat, said cross section being taken generally along the plane XIV—XIV of FIG. 4.

The chair 1 of the present invention comprises a stretcher 20 operably mounted on a base 10 for supporting at its ends a pair of spaced side rails (FIGS. 1 and 2). Secured to side rails 30 are a formed plastic supporting seat 40 and a formed plastic supporting back 50 (FIGS. 1 and 4) each having at its side edges side channels 41 and 51 respectively which are seated over side rails 30 (FIGS. 3, 4, 5, 6, 7 and 8). Secured to seat 40 is a formed plastic inner seat 60 having a configuration comforming generally to that of supporting seat 40 and being covered by upholstery covering 70 (FIGS. 1 and 14). Secured to back 50 is a formed plastic inner back 80 which is covered by back upholstery covering 90 (FIGS. 1 and 15). The arms 100 of chair 1 may be optionally attached to the chair by securement to stretcher 20 (FIGS. 1 and 3).

Figure 18:
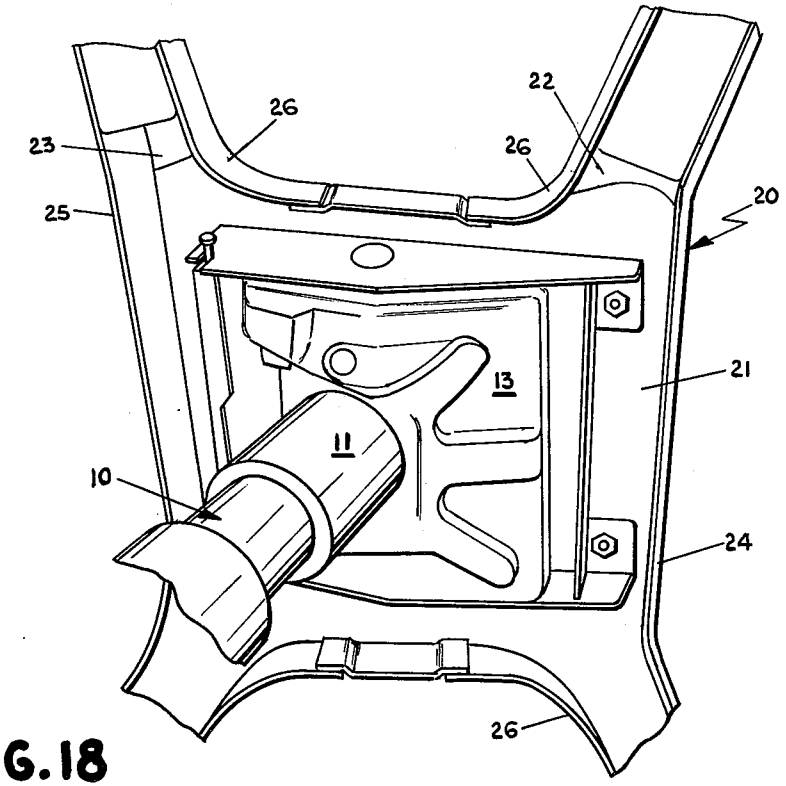
FIG. 18 is a bottom, fragmentary view showing the central portion of the stretcher with the upper portion of the base attached thereto.

Base 10 is a pedestal type of base having a post 11 with a plurality of legs 12 projecting outwardly from generally the bottom thereof and with a chair tilter control 13 or other mounting mechanism positioned generally at the top of post 11 (FIGS. 1 and 18). Stretcher 20 includes an enlarged, generally square shaped central mounting pan 21 to which control 13 is fastened by bolts or like fasteners.

Stretcher 20 is formed of stamped steel. Projecting outwardly from each side of central mounting pan 21 are a front strut 22 and a rear strut 23 (FIGS. 2, 3 and 18). Bent over along the front of stretcher 20 is a front wall 24 which extends downwardly across the front edge of mounting pan 21 and across the leading edge of both front struts 22. Projecting downwardly from the rear edge of stretcher 20 is rear wall 25 which extends along the rear edge of mounting pan 21 and along the rear edges of rear struts 23. In a similar fashion, a side wall 26 extends downwardly and runs along the side edges of mounting pan 21 and extends outwardly along the inside edges of front and rear struts 22 and 23 which face each other. All of these downwardly depending walls 24, 25 and 26 to help to hide from view the control 13 of base 10 and its securement to stretcher 20. Also, the downwardly depending walls give added strength to stretcher 20. Finally, in extending along struts 22 and 23, these walls give the struts a generally downwardly opening channel shaped configuration which facilitates the mounting of arms 100 to the struts 22 and 23 of stretcher 20. Preferably, the front channels 22 and front wall 24 are formed as one piece, the rear channels 23 and rear wall 25 are formed as one piece and mounting pan 21 is formed as one piece. These three pieces are then welded together to form an integral stretcher 20.

Stretcher 20 also includes an upwardly protruding dome 27 generally in the center of mounting pan 21 which leaves clearance space for the top of control 13 of base 10. More importantly, dome 27 provides a support for supporting seat 40. The distance between the bottom of supporting seat 40 and the top of dome 27 is about ⅜ inch. It is a sufficiently small distance that when a person sits on the chair, supporting seat 40 comes to rest on the top of dome 27 before sufficient stress is put on channels 41 to cause them to upwrap from or, in other words, be pulled off of side rails 30. In essence, dome 27 serves as a support so that at least some of the load imposed on the chair is transmitted directly axially downwardly onto dome 27 and from thence to the column 11 of base 10. This diminishes the amount of stress which has to be carried by side rails 30. As a result, the need for extensive, complicated fastening between channels 41 and side rails 30 is minimized. Also, side rails 30 and the struts of stretcher 20 can be more economically manufactured. This function and further detail of dome 27 are more fully described in copending patent application Ser. No. 463,131, invented by Richard H. Baker, filed on even date herewith, assigned to the assignee of this application and specifically incorporated herein by reference.

The side rails 30 which are welded to the ends of struts 22 and 23 are tubular steel members bent to define a seat supporting portion 31 and a back supporting portion 32 (FIG. 2). They can be bent into any of a number of different configurations to give the chain a particular aesthetic or ornamental appearance.

Supporting seat 40 is formed by injection molding of a polypropylene copolymer (approximately 13% polyethylene). Other plastics and other forming methods can be used. Seat 40 should be quite rigid, having a thickness of approximately 5/32 inch. When supported on side rails 30, supporting seat 40 serves to support a person seated in the chair. While the shape of supporting seat 40 is to some extent dictated by comfort considerations, the ornamental designer does have some leeway and can affect his design theme by varying the shape to be given seat 40, particularly at the front, rear and side edge portions.

Figure 5:
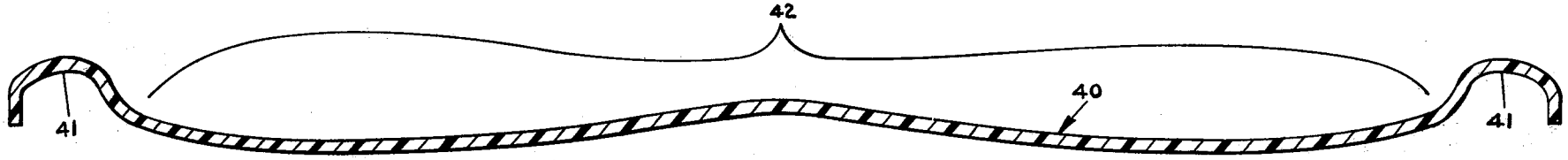
FIG. 5 is a cross-sectional view of the formed plastic seat taken generally along plane V—V of FIG. 4.
Figure 19:
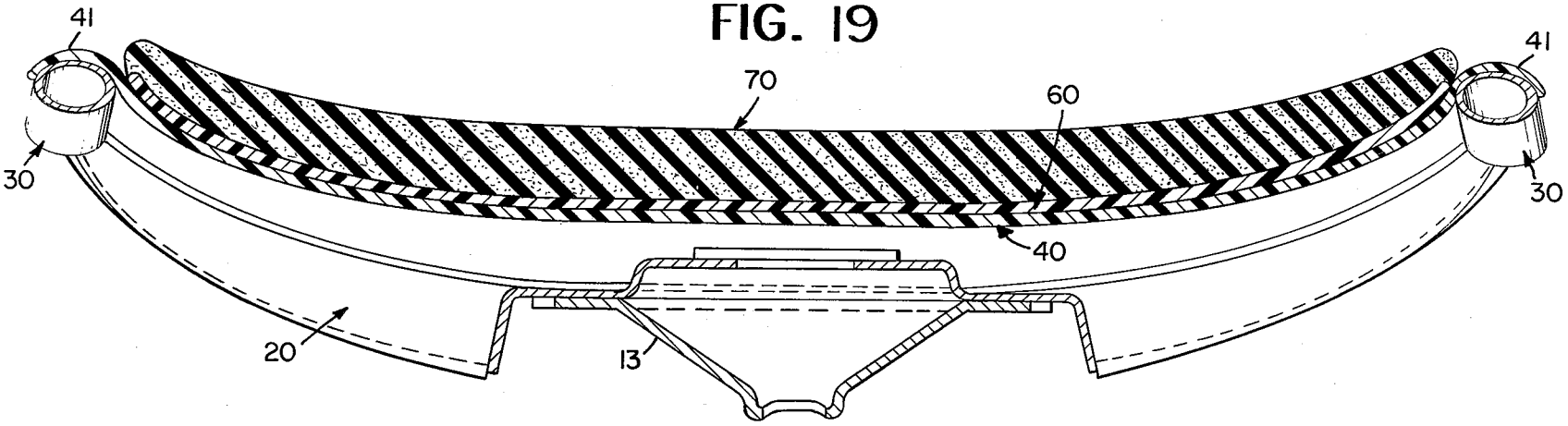
FIG. 19 is a lateral cross-sectional view taken along plane XIX—XIX of FIG. 1.

The channels 41 wich are formed at each side of seat 40 are raised generally with respect to the rest of seat 40 so as to define a well 42 between the spaced channels 41 (FIG. 5 and 19). It is not essential that the entire surface of seat 40 be below the level of the tops of channel 41 (it will be noticed that seat 40 raises somewhat towards the middle) but it is preferable that there be a well-like depression at least in the area adjacent the side channels 41. In this manner, when the upholstered inner seat 60 is secured to supporting seat 40, its edges will be positioned fairly closely adjacent the inside wall of the raised channels 41 and it will be more difficult to get underneath the seat upholstery pad 60 and pry it upwardly.

Figure 6:
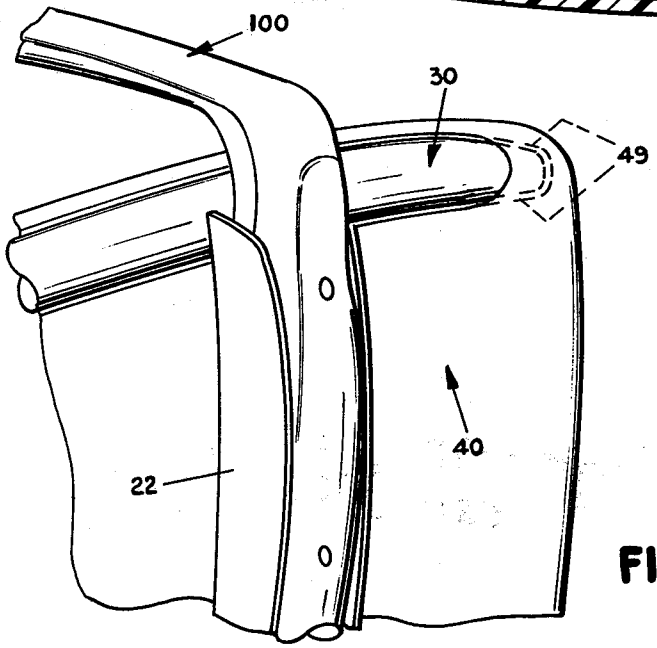
FIG. 6 is a fragmentary bottom view of the front left hand corner of the chair, that portion being indicated generally by the arrow VI on FIG. 4.

At the underside of seat 40, at each front corner of seat 40, each side channel 41 terminates in a recessed pocket 49 into which the forward end of side rail 30 extends (FIG. 6). This not only serves to hide the end of side rail 30, but also serves to secure supporting seat 40 in place at the front of the chair.

Figure 7:
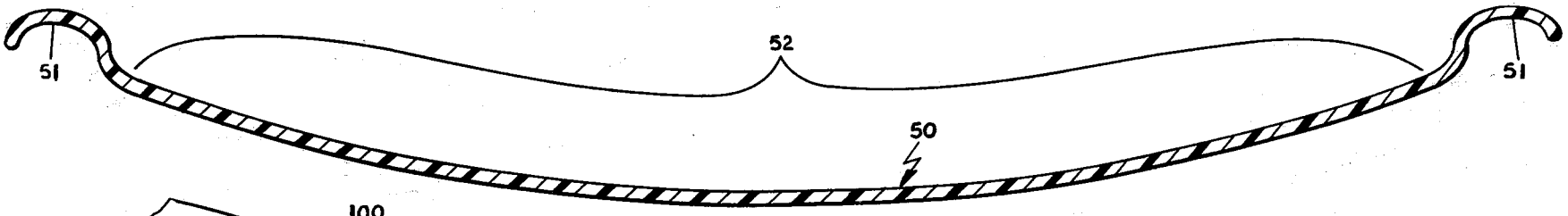
FIG. 7 is a cross-sectional view of the formed plastic back taken generally along plane VII—VII of FIG. 4.
Figure 20:
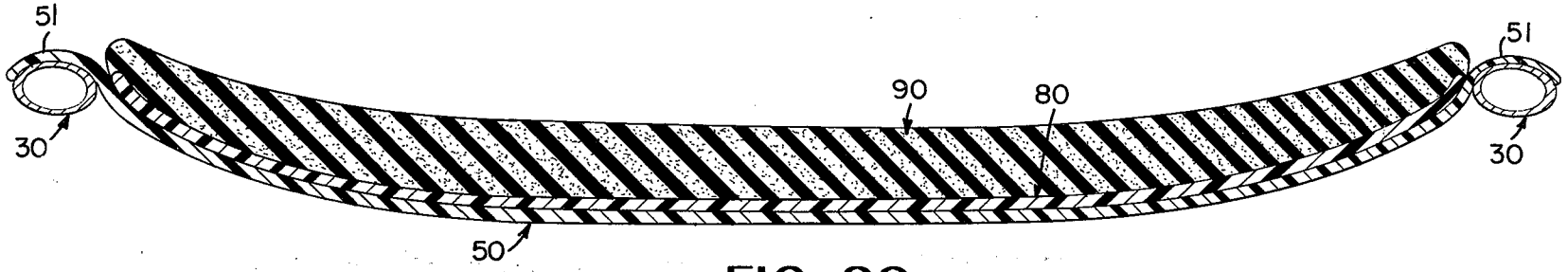
FIG. 20 is a lateral cross-sectional view taken along plane XX—XX of FIG. 1

Back 50 is formed by injection molding of a polypropylene copolymer (approximately 13% polyethylene). Other plastics and other forming methods can be used. Back 50 should be quite rigid, having a thickness of approximately 5/32 inch. When supported on side rails 30, supporting back 50 serves to support a person leaning back in the chair. As with seat 40, the shape of supporting back 50 is to some extent controlled by comfort considerations. However, the designer has some leeway for purely ornamental considerations, particularly along the top, bottom and side portions. The channels 51 are formed at each side of back 50 so as to define a well 52 between the spaced channels 51 (FIG. 7 and 20). It is not essential that the entire surface of back 50 be below the level of the tops of channel 51, but it is preferable that there be a well-like depression at least in the area adjacent the side channels 51. In this manner, when the upholstered inner back 80 is secured to supporting back 50, its edges will be positioned fairly closely adjacent the inside wall of the raised channels 51 and it will be more difficult to get underneath the back upholstery pad 80 and pry it upwardly.

Figure 8:
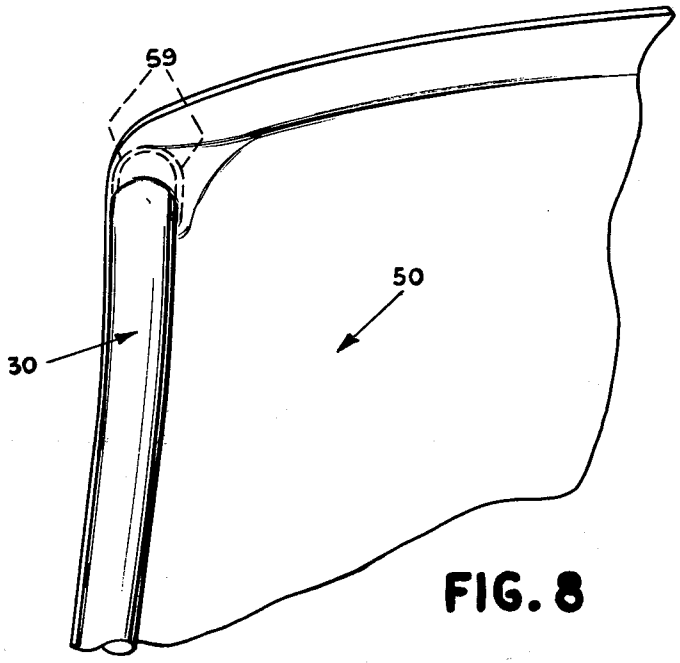
FIG. 8 is a fragmentary rear view of the upper left hand corner of the chair; that fragmentary portion being indicated generally by the arrow VIII shown on FIG. 4.

At the backside of back 50, at each top corner of back 50, each side channel 51 terminates in a recessed pocket 59 into which the upper end of side rail 30 extends (FIG. 8). This not only serves to hide the end of side rail 30, but also serves to secure back 50 in place at the back of the chair.

Figure 4:
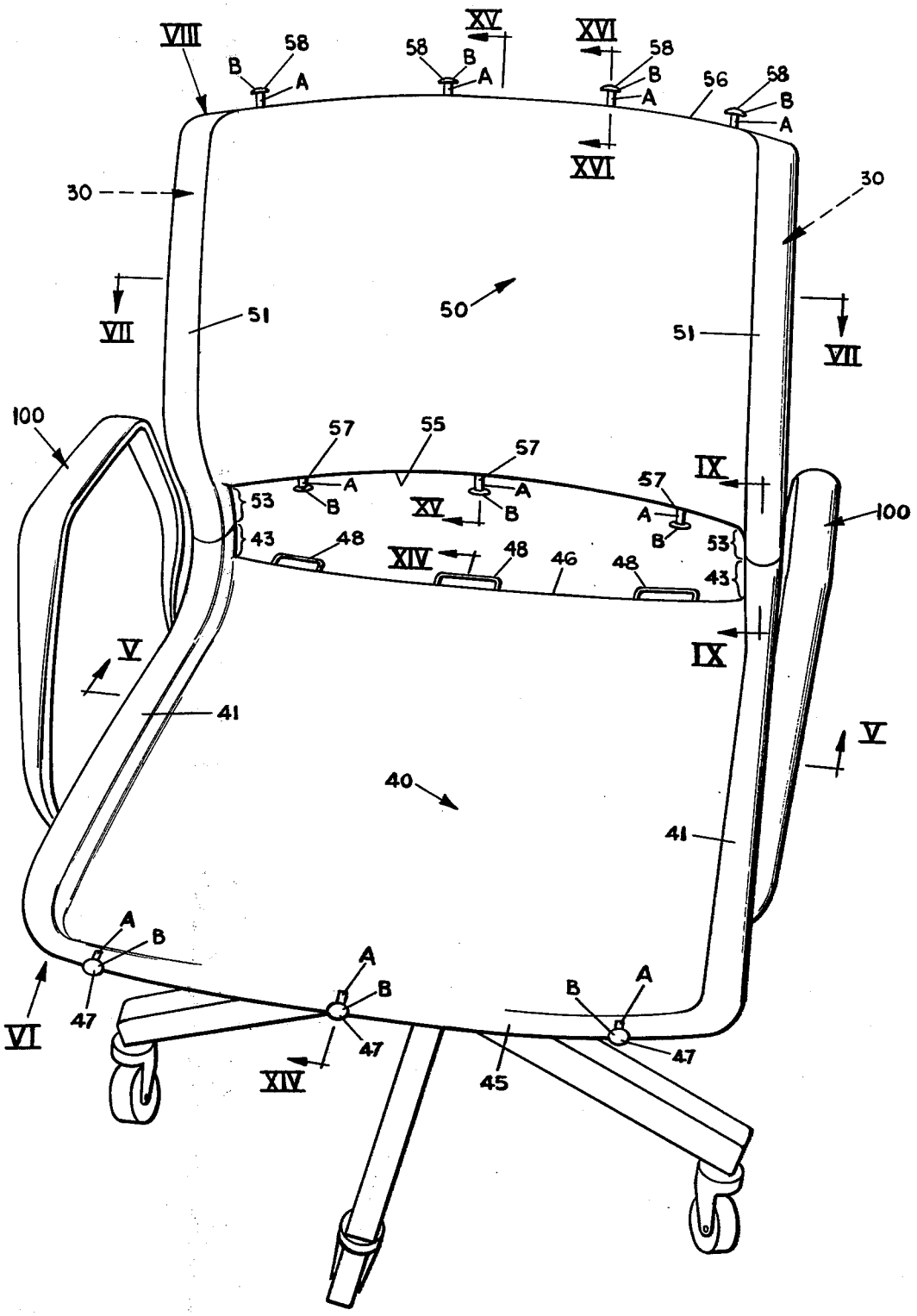
FIG. 4 is a perspective view of the chair before the inner seat and back have been attached.
Figure 9:
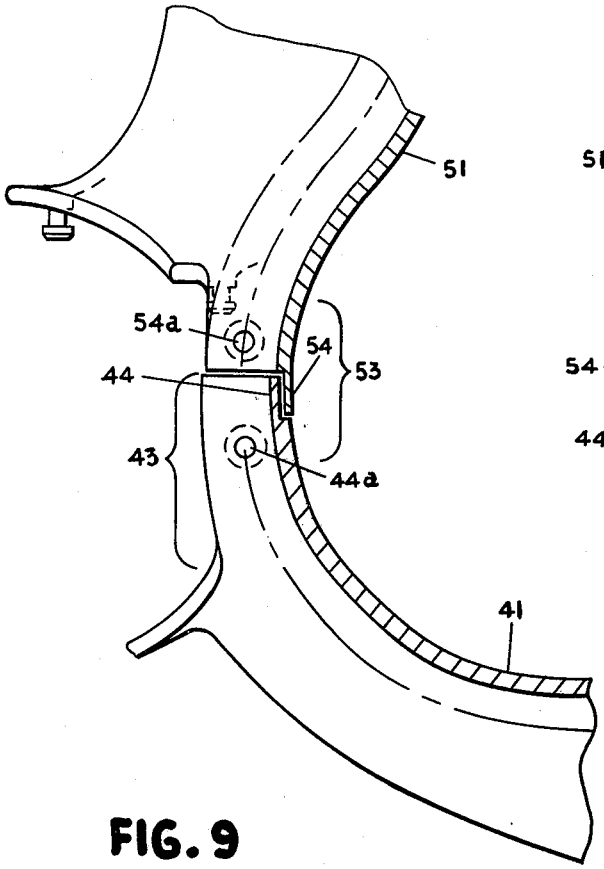
FIG. 9 is a fragmentary cross-sectional view of the overlapping portions of the formed plastic seat and backs taken generally along plane IX—IX of FIG. 4.
Figure 10:
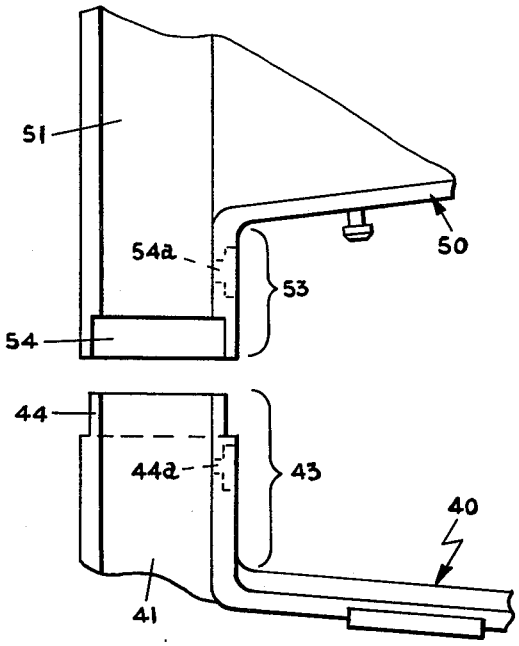
FIG. 10 is a fragmentary, rear view of the portions of the seat and back which are shown in FIG. 9, said portions being shown separated in FIG. 10.

The side channels 41 of set 40 include projecting portions or seat channel projections 43 which project rearwardly and upwardly from the rear edge of seat 40 towards back 50 (FIGS. 4, 9 and 10). Similarly, the side channels 51 of back 50 include projecting portions or back channel projections 53 which project downwardly from the bottom of back 50 towards seat 40. Channel projection 43 terminates in a channel shaped flange 44 while channel projection 53 terminates in a channel shaped overlying flap 54. Flap 54 overlaps flange 44 so that the side channels 41 and 51 meet in such a way as to align channel projections 53 and 43 and to define a continuous, smooth flowing surface with only a slight line being visible at the junction. Once flap 54 is seated over flange 44, a screw is passed through a screw hole 54*a* in the inside of channel projection 53 (FIG. 9), above flap 54, and is threaded into underlying side rail 30. Similarly, a screw is passed through screw hole 44*a* in the inside of channel projection 43 and is threaded into underlying side rail 30. This positively locks supporting seat 40 and supporting back 50 in place at their rear and bottom respectively so that once the ends of side rails 30 are in place in the pockets 49 and 59 of seat 40 and back 50 respectively and once the projecting side channel portions 43 and 53 are in their proper overlapping condition and secured by screws through holes 54*a* and 44*a*, the back 50 and seat 40 are firmly secured to side rails 30.

Seat 40 is rolled over along its front edge 45 and includes three integrally molded buttons 47 projecting from its front edge 45 at spaced intervals therealong (FIGS. 4 and 14). Projecting from the rear edge 46 of seat 40 are three spaced integrally molded tabs 48. In a somewhat similar manner, four integrally molded buttons 58 project upwardly at spaced intervals from the rolled over top edge 56 of back 50 (FIGS. 4 and 16) and three integrally molded buttons 57 project downwardly from the rolled over bottom edge 55 of back 50 (FIGS. 4 and 15). These integrally molded projecting buttons and tabs facilitate securement of the upholstered inner seat 60 and inner back 80 to seat 40 and back 50 respectively.

Figure 12:
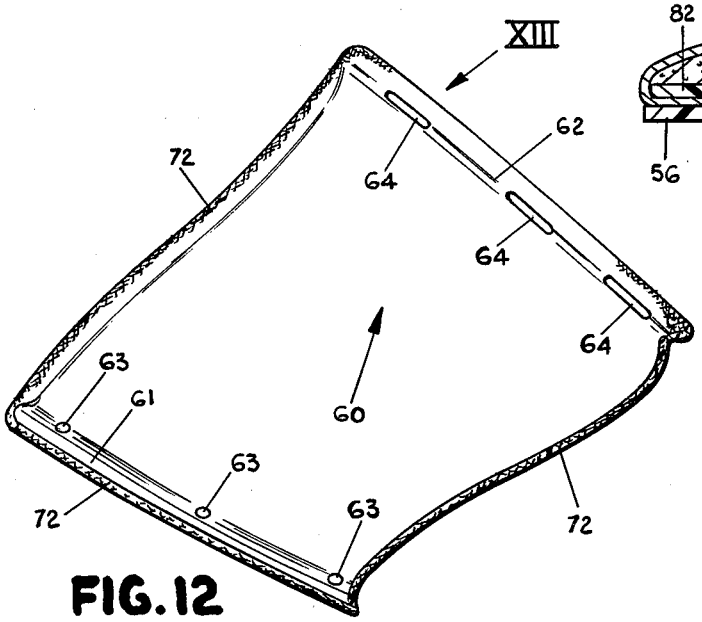
FIG. 12 is a generally bottom perspective view of the formed plastic inner seat covered with upholstery
Figure 13:
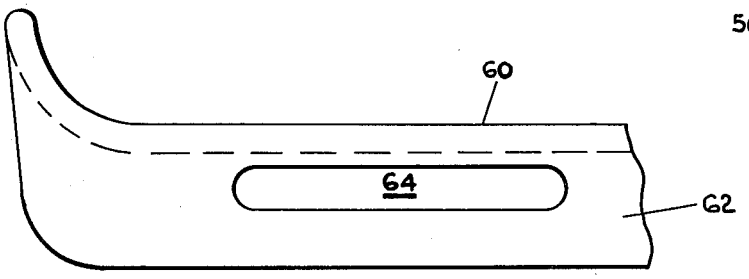
FIG. 13 is a fragmentary elevational view of the rear corner of the inner seat with the upholstery covering removed, said area being indicated generally by arrow XIII of FIG. 12.

Inner seat 60 is preferably injection molded of basically the same plastic of which supporting seat 40 and supporting back 50 are made and has a thickness of approximately ⅛ inch. It should have sufficient thickness and rigidity that it will hold its shape when secured to supporting seat 40 and such that it will not be bent out of shape when it is covered with upholstery covering 70. It is molded to have a configuration conforming generally to the configuration of the inside of supporting seat 40 within well 42 (FIGS. 5, 12 and 14). Inner seat 60 is approximately as wide as the distance between the inwardly facing walls of side channels 41 of supporting seat 40. Inner seat 60 is rolled over along its front edge to define a front lip 61 and it is turned sharply over along its rear edge to define a rear lip 62. Front lip 61 includes three spaced holes 63 there in whose positions correspond generally to the front projecting buttoms of seat 40. In this manner, inner seat 60 is secured along the front edge of supporting seat 40 by snapping the enlarged heads of projecting buttons 47 through the holes 63 of inner seat 60. Rear lip 62 includes three spaced slots 64 (FIGS. 12 and 13) spaced at intervals corresponding to the spacing of tabs 48, and each having a length corresponding approximately to the width of a tab 48, so that the rear of inner seat 60 is secured in place by snapping rear lip 62 over the rear edge 46 of supporting seat 40 with tabs 48 projecting into slots 64.

Figure 11:
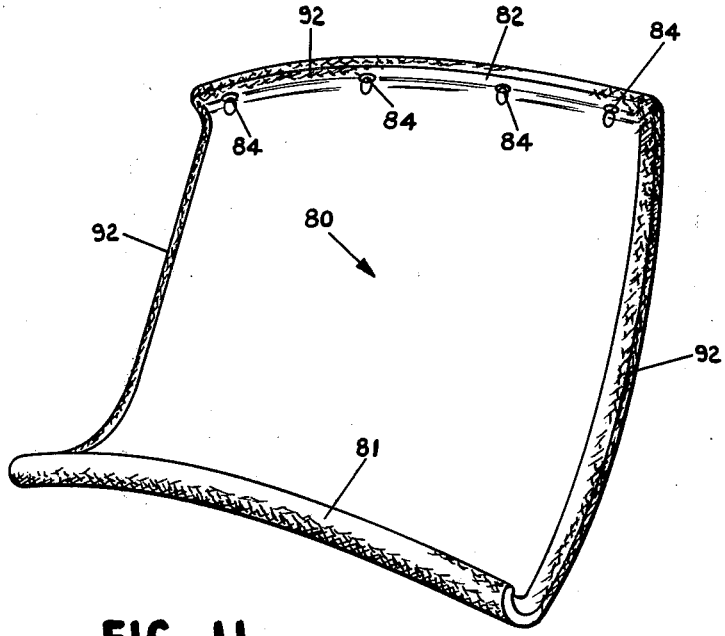
FIG. 11 is a generally rear perspective view of the formed plastic inner back covered with upholstery.
Figure 16:
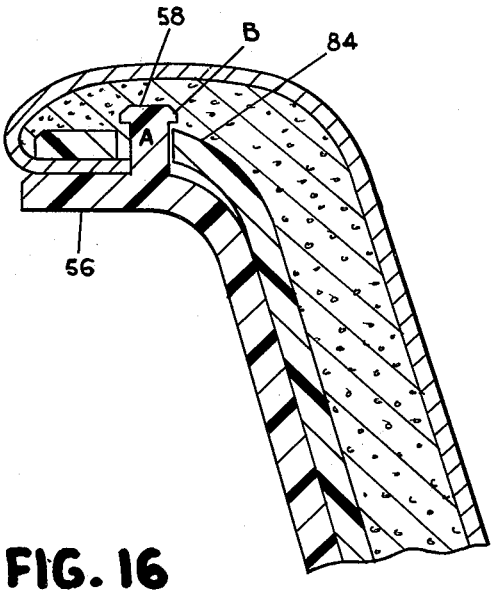
FIG. 16 is a fragmentary, cross-sectional view of the upper portion of the upholstered inner back taken generally along XVI—XVI of FIG. 4.

Inner back 80 is similarly molded of basically the same plastic of which supporting seat 40 and supporting back 50 are molded and has a thickness of approximately ⅛ inch. As with inner seat 60, inner back 80 must have sufficient thickness and rigidity to hold its shape during the covering process and to hold its shape when secured to supporting back 50. Inner back 80 is molded to have a configuration corresponding generally to the configuration of the front surface of supporting back 50 in the area of the well 52 of back 50 (FIGS. 11 and 15). Inner back 80 is approximately as wide as the distance between the inwardly facing walls of side channels 51 of supporting back 50. Inner back 80 includes a rolled over bottom lip 81 and a rolled over top lip 82 which fit over the bottom edge 55 and top edge 56 of back 50 respectively. Top lip 82 includes four spaced holes 84 therein which receive the four spaced top projecting buttons 58 of back 50 and bottom lip 81 includes three spaced bottom holes 83 into which snap the heads of bottom buttons 57. FIG. 16 is particularly helpful in visualizing the manner in which the enlarged heads of the projecting buttons snap into and through the receiving holes. Further details of the upholstery system are also set forth in copending application, Ser. No. 463,191, by Richard H. Baker and Robert C. Clawson, filed on even date herewith, assigned to the assignee of this application, and incorporated herein by reference.

Inner seat 60 is covered with an upholstery covering composite 70 which includes a layer of cushioning material 71 and suitable upholstery material 72 (FIG. 14). The cushioning material is adherred to the top surface of inner seat 60 with a suitable adhesive. Similarly, the upholstery 72 is adherred to the cushioning material 71 by suitable adhesive. Additionally, the upholstery 72 is wrapped around all of the edges of inner seat 60 and is attached by adhesive or possibly by other fastening means along the upholstery edges to the rear surface of inner seat 60. FIG. 12, which is a view of inner seat 60 from the underside, is helpful in illustrating the manner in which the upholstery 72 is wrapped around the edges of inner seat 60 and adherred to the rear of undersurface thereof.

Back upholstery covering composite 90 is similar and includes a layer of cushioning material 91 which is adherred to the front surface of inner back 80 and a layer of upholstery 92 which covers cushioning 91. Upholstery 92 is wrapped around all of the edges of inner back 80 and is attached to the rear surface thereof as above. FIG. 11 is a generally rear perspective view of inner back 80 and shows the manner in which upholstery 92 is wrapped over its edges and adherred to the rear surface thereof.

Figure 17:
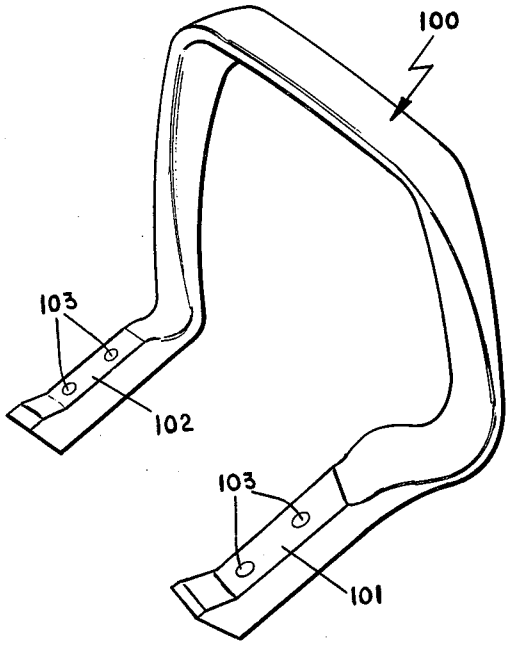
FIG. 17 is a generally perspective view of the chair arm, looking at the arm from its chair facing side.

Arms 100 of the present chair are an optional attachment (FIGS. 2, 3 and 17). Each arm 100 is a bar of metal such as cast aluminum, or the like which is generally U-shaped in configuration and which includes a forward end portion 101 and a rear end portion 102 which project inwardly toward the center of the chair, out of the generally vertical plane of the remainder of the generally U-shaped arm 100. The forward projecting end portion 101 fits snugly into the channel defined by front strut 22 of stretcher 20 and the rear end portion 102 fits snugly into the channel defined by rear strut 23. Each end portion includes a pair of spaced threaded bolt holes 103 therein whereby a suitable bolt fastening can be used to secure the end portions 101 and 102 to their respective struts 22 and 23. It will be noted that matching holes 104 are provided in all of the struts to facilitate passing of the bolts through the struts.

In assembly, the inner seat 60 and inner back 80 are covered with cushioning 71 and 91 respectively and upholstery 72 and 92 respectively in the manner indicated above. Arms 100 may be added optionally to the struts of stretcher 20. The supporting seat 40 and supporting back 50 are then secured to the side rails 30 in the manner indicated above and the covered inner seat and inner back are secured to the supporting seat and supporting back respectively in the manner indicated above. The completed assembly is then secured to base 10.

The completed chair is one which is durable, capable of being highly styled and is yet inexpensive. Styling can be significantly effected by either adding or leaving off the arms 100. As such, the invention represents a highly significant contribution to the office furniture industry.

Of course, it is understood that the above is merely a preferred embodiment of the invention in that various changes and alterations can be made without departing from the spirit and broad aspects of the invention as set forth in the attached claims.

The embodiments of the invention in which an exclusive property or privilege is claimed are defined as follows:

1. A chair comprising: a base; a stretcher operably mounted on said base and having one end at one side of said chair and another end at the other side of said chair; a pair of spaced side rails, one joined to said one end of said stretcher and the other joined to said other end of said stretcher, each said side rail being continuous and having a seat supporting portion and a back supporting portion; formed, plastic supporting seat and back means including an integrally formed, downwardly opening channel immediately at each side edge thereof whereby the body supporting portions of said supporting seat and back means lies entirely between said channels; said supporting seat and back means being operably connected to said side rails, with each said channel being seated over one of said side rails and generally following the contour of its respective side rail as it extends along the seat and back supporting portions of its respective side rail whereby said side rails define the contour of said chair along its side edges; formed plastic inner seat and back means having a shape conforming generally to the front surface of said supporting seat and back means; upholstery covering means covering the face of said inner seat and back means, said upholstery covering means including upholstery wrapped around the edges of said inner seat and back means to the rear surface thereof; means securing said inner seat and back means to said supporting seat and back means; and said inner seat and back means terminating along their side edges short of and adjacent said channels whereby the presence of said side rails is accentuated and readily apparenet even when said chair is viewed from the front and whereby said side rails serve as a visual focal point of said chair.

2. The chair of claim 1 comprising: each of said channels being raised above the level of the remainder of said supporting seat and back means, at least in the portions adjacent said channel, to define a receiving well between said channels, said inner seat and back means having dimensions such that it fits snugly within said receiving well, between said raised channels, whereby one cannot readily pry underneath the side edges of said inner seat and back means.

3. The chair of claim 2 in which said inner seat and back means includes a front lip extending over the front edge of the seat portion of said supporting seat and back means and a top lip extending over the top edge of the back portion of said supporting seat and back means, whereby one cannot readily pry underneath said front lip and said top lip of said inner seat and back means.

4. The chair of claim 2 in which said supporting seat and back means comprises a separate supporting seat and a separate supporting back and said inner seat and back means comprises a separate inner seat and a separate inner back; said inner seat including a front lip wrapping over the front edge of said supporting seat and a back lip wrapping over the back edge of said supporting seat whereby one cannot readily pry under the front or rear of said inner seat; said inner back including a bottom lip extending over the bottom edge of said supporting back and a top lip extending over the top lip of said supporting back whereby one cannot readily pry under said bottom and top lips of said inner back.

5. The chair of claim 1 in which said stretcher includes a large central mount operably connected to said base and a front and rear strut projecting laterally from each side of said central mount, each said side rail being connected to the ends of the said front and rear struts on its respective side of said central mount.

6. The chair of claim 5 including an arm having two mounting end portions projecting inwardly towards the center of said chair from generally the bottom of said arm, one of said mounting end portions being secured to the forward strut on one side of said chair and the other of said mounting end portions being secured to said rear strut; one of said arms being secured to each side of said chair.

7. The chair of claim 6 in which each of said forward and rear struts comprises a downwardly opening channel, said mounting end portions of said arm being received in and being hidden in said channel.

8. The chair of claim 7 in which said stretcher has a front downwardly depending wall and a rear downwardly depending wall to provide strength and to provide a surface behind which the operable connection of said base to said stretcher is somewhat concealed from view.

9. The chair of claim 1 in which said stretcher has a front downwardly depending wall and a rear downwardly depending wall to provide strength and to provide a surface behind which the operable connection of said base to said stretcher is somewhat concealed from view.

10. The chair of claim 9 in which each said side rail comprises a bent metal tube.

11. The chair of claim 1 in which each of said side channels of said supporting seat and back means terminates at its forward end in a seat pocket and terminates at its upper end in a back pocket; the forward end of each said side rail being received in its respective seat pocket and the upper end of each said side rail being received in its respective back pocket whereby said supporting seat and back means are secured to said side rails.

12. The chair of claim 11 in which said supporting seat and back means comprise a separate supporting seat and a separate supporting back, said inner seat and back means comprising a separate inner seat and a separate inner back, said inner seat being secured to said supporting seat and said inner back being secured to said supporting back; each said side channel on said supporting back including a projecting portion projecting downwardly from the bottom of said back toward said supporting seat; each said side channel of said supporting seat including a projecting portion projecting upwardly toward said supporting back; each said supporting back side channel projecting portion and said supporting seat side channel projecting portion at least meeting; means for securing said projecting channel portions to their respective side rails whereby said supporting seat and supporting back are held down at said projecting channel portions as well as through the engagement of said side rails in said seat and back pockets.

13. The chair of claim 12 in which said securing means for securing said projecting portions to their respective side rails comprises a fastener inserted into said side rail.

14. The chair of claim 12 in which said inner seat includes a front lip extending over the front edge of said supporting seat and a back lip extending over the back edge of said supporting seat and said inner back includes a bottom lip extending over the bottom edge of said supporting back and top lip extending over the top edge of said supporting back.

15. A chair comprising: a base, a stretcher operably connected to said base; seat and back means operably connected to said stretcher, said stretcher being generally visible beneath said seat and back means; said stretcher including a central mounting means for operably connecting to said base and front and rear struts projecting laterally from each side of said central mount; each of said struts having a downwardly opening, generally channel shaped cross-sectional configuration; an arm on each side of said chair, said arm including a pair of inwardly projecting end mounting portions spaced forwardly and rearwardly from one another, the forward one of said end mounting portions being received up within said forward strut and the rear one of said end mounting portion being received up within said rear strut whereby said end mounting portions are generally hidden when said chair is viewed from the front or rear; means securing each of said end mounting portions to each of said struts; and said stretcher having a front downwardly depending wall and a rear downwardly depending wall to provide strength and to provide a surface behind which the operable connection of said base to said stretcher is somewhat concealed from view.

16. The chair of claim 15 in which said arm comprises a shaped number having a generally U-shaped configuration, the ends of the member extending inwardly generally laterally of the general plane of the U-shaped portion of said arm, each of said inwardly extending ends defining said end mounting portions of said arm.

17. The chair of claim 16 in which said means securing said end mounting portions to said struts comprise fasteners.

* * * * *

UNITED STATES PATENT AND TRADEMARK OFFICE

CERTIFICATE OF CORRECTION

PATENT NO. : 3,947,068

DATED : March 30, 1976

INVENTOR(S) : Randall P. Buhk

It is certified that error appears in the above-identified patent and that said Letters Patent are hereby corrected as shown below:

Column 1, line 61:
"chain" should be ---chair---;
Column 4, Line 8:
"chain" should be ---chair---;
Column 4, Line 22:
"wich" should be ---which---;
Column 5, Line 3:
"set" should be ---seat---;
Column 5, Line 62:
"buttoms" should be ---buttons---;
Column 6, line 36:
"adherred" should be ---adhered---;
Column 6, Line 38:
"adherred" should be ---adhered---;
Column 6, Line 46:
"adherred" should be ---adhered---;
Column 6, Line 50:
"adherred" should be ---adhered---;
Column 6, Line 56:
"adherred" should be ---adhered---;
Column 7, Line 63, Claim 1:
"apparenet" should be ---apparent---;
Column 10, Line 26, Claim 16:
"number" should be ---member---.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*